US005340501A

United States Patent [19]

Steindorf

[11] Patent Number: 5,340,501

[45] Date of Patent: Aug. 23, 1994

[54] SOLID HIGHLY CHELATED WAREWASHING DETERGENT COMPOSITION CONTAINING ALKALINE DETERSIVES AND AMINOCARBOXYLIC ACID SEQUESTRANTS

[75] Inventor: Richard E. Steindorf, West St. Paul, Minn.

[73] Assignee: Ecolab Inc., St. Paul, Minn.

[21] Appl. No.: 608,009

[22] Filed: Nov. 1, 1990

[51] Int. Cl.[5] ..... C11D 3/04; C11D 3/33; C11D 17/00

[52] U.S. Cl. ..... 252/546; 252/135; 252/527; 252/156; 252/174

[58] Field of Search ..... 252/180, 135, 181, 174, 252/174.16, 95, 102, 98, 527, 156, 546

[56] References Cited

U.S. PATENT DOCUMENTS

| | | | |
|---|---|---|---|
| 3,392,121 | 9/1964 | Gedge III, | 252/136 |
| 3,691,082 | 9/1972 | Stimberg | 252/98 |
| 4,127,496 | 11/1978 | Stokes | 252/102 |
| 4,595,520 | 6/1986 | Heile et al. | 252/160 |
| 4,680,134 | 7/1987 | Heile et al. | 252/160 |
| 4,698,101 | 10/1987 | Lewis | 252/527 |
| 4,704,233 | 11/1987 | Hartman et al. | 252/527 |
| 4,753,755 | 6/1988 | Gansser | 252/527 |
| 4,846,989 | 7/1989 | Killa | 252/174 |
| 4,846,990 | 7/1989 | Upadek et al. | 252/8.8 |
| 4,846,993 | 7/1989 | Lentsch | 252/95 |
| 4,933,102 | 6/1990 | Olson | 252/174 |
| 4,935,065 | 6/1990 | Bull | 252/174.16 |
| 4,971,714 | 11/1990 | Lokkesmoe | 252/181 |
| 4,983,315 | 1/1991 | Glogowski | 252/180 |

FOREIGN PATENT DOCUMENTS

| | | |
|---|---|---|
| 663325 | 11/1965 | Belgium . |
| 1037475 | 4/1985 | European Pat. Off. . |
| 2810999 | 9/1978 | Fed. Rep. of Germany . |

OTHER PUBLICATIONS

Attachment 1—International Search Report, International Application No. PCT/US91/02869, International Filing Date Apr. 25, 1991, Ecolab Incorporated.

*Primary Examiner*—Paul Lieberman
*Assistant Examiner*—E. Higgins
*Attorney, Agent, or Firm*—Merchant, Gould, Smith, Edell, Welter & Schmidt

[57] ABSTRACT

A solid, cast, highly chelated, alkaline detergent composition which includes (i) a potassium salt of an aminocarboxylic acid sequestrant, such as ethylene diamine tetraacetic acid (EDTA), (ii) optionally a sodium salt of the aminocarboxylic acid sequestrant, (iii) a source of alkalinity, such as sodium and/or potassium hydroxide, and (iv) a solidifying agent. The composition contains at least one of the sodium salt of the aminocarboxylic acid sequestrant and/or the sodium form of the alkaline source.

6 Claims, 1 Drawing Sheet

36,000
32,000
28,000
24,000
20,000
16,000
12,000
8,000
4,000
VISCOSITY (CPS)
6.8% NaOH
22% KOH
4.5% NaOH
24% KOH
2.2% NaOH
25% KOH
1
2
3
4
5
6
TIME (hours)

SOLID HIGHLY CHELATED WAREWASHING DETERGENT COMPOSITION CONTAINING ALKALINE DETERSIVES AND AMINOCARBOXYLIC ACID SEQUESTRANTS

FIELD OF THE INVENTION

Broadly, this invention relates to solid, cast, alkaline detergent compositions and methods for making them. Specifically, this invention relates to solid, cast, chelated, alkaline warewashing compositions which include the highly reactive combination of an aminocarboxylic acid sequestrant, such as ethylenediaminetetraacetic acid (EDTA), and a sodium based source of alkalinity, such as sodium hydroxide.

BACKGROUND OF THE INVENTION

Solid alkaline detergent compositions are widely used for household and institutional dishwashing, laundering, and general surface cleaning. Such detergent compositions are commonly produced as solid cast blocks which are about 2 to about 20 kg in size. The manufacturing process employed to produce such cast blocks detergent typically involves heating an aqueous emulsion of the individual components to form a molten melt, blending the molten melt to form a homogeneous mixture, and then casting, cooling and solidifying the mixture.

One component frequently used in the manufacture of solid detergent compositions is a source of alkalinity such as an alkali metal hydroxide and/or and alkali metal silicate. Alkaline sources are known to be effective for removing soils from various substrates.

A second component frequently used in the manufacture of solid detergent compositions is a chelating agent (also known as complexing agents and sequestering agents). Chelating agents aid in maintaining solubilization of the ionic hardness components of service water such as calcium, magnesium, iron, and manganese so as to prevent the hardness components from interfering with the cleaning action of the detergent components. When using service water having a high concentration of hardness components, the use of a detergent composition with a high concentration of a chelating agent is important in order to obtain satisfactory cleaning performance.

One recognized class of useful chelating agents is the aminocarboxylic acids. These compounds are a well known class of compounds that have found uses in a variety of cleaning compositions as a chelating agent including many of the solid cast detergent compositions. However, use of aminocarboxylic acids has been limited in detergent compositions which also employ a source of alkalinity as the aminocarboxylic acids tend to react so rapidly with typical sources of alkalinity that the combination solidifies before it can be properly blended and cast.

Accordingly, a substantial need exists for a detergent composition having both an effective chelating amount of an aminocarboxylic acid sequestrant and an effective detersive amount of an alkaline source which may be readily processed in common processing equipment.

SUMMARY OF THE INVENTION

Figure 1:
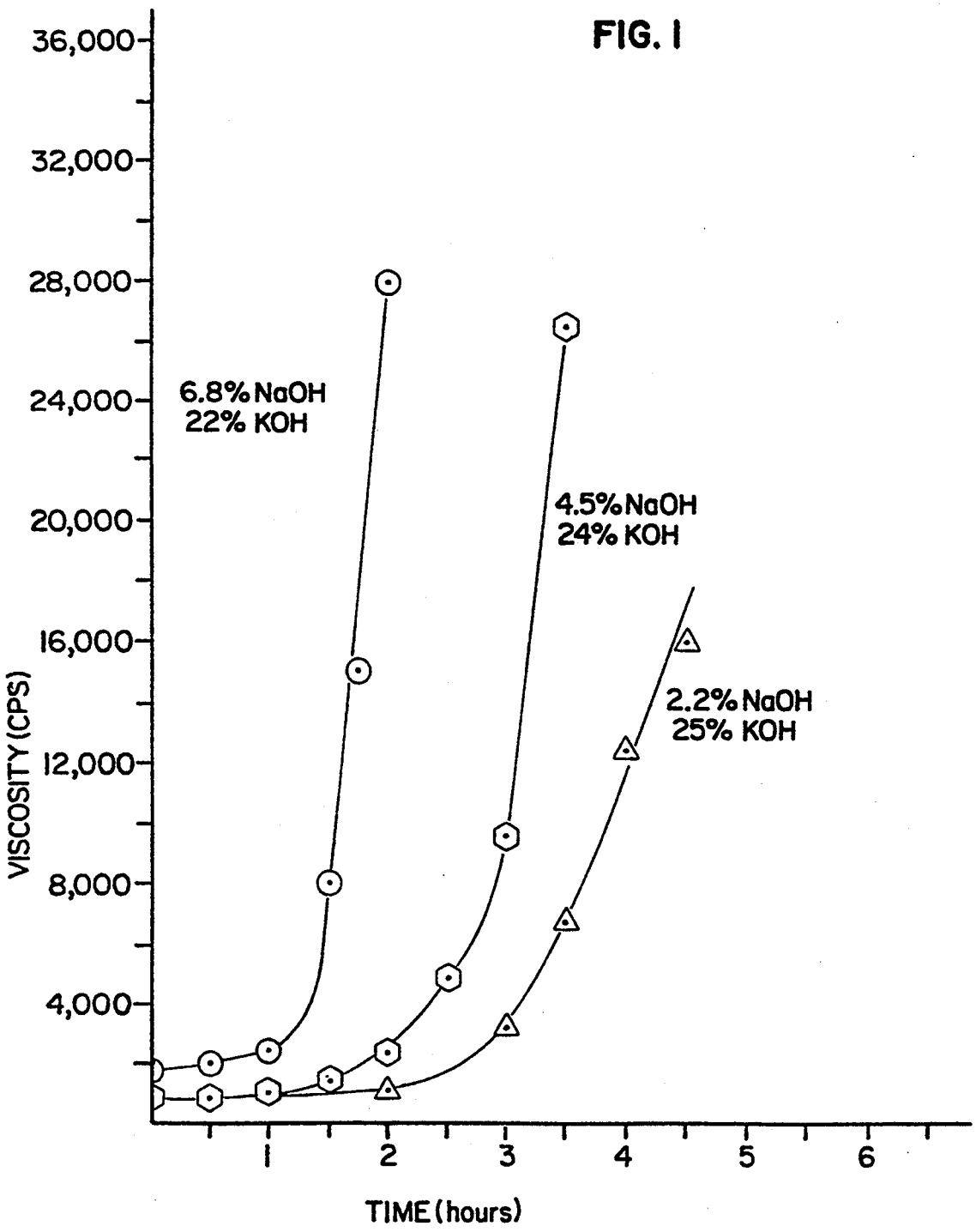
FIG. 1 is a graph depicting the rate of solidification for aminocarboxylic acid containing detergent compounds with different ratios of NaOH to KOH.

A detergent composition comprising a substantially homogeneous solid product which includes at least an effective hard surface cleansing proportion of an alkaline source and an effective chelating proportion of an aminocarboxylic acid sequestrant wherein at least a portion of the alkaline source is in the form of a sodium salt and at least a portion of the aminocarboxylic acid sequestrant is in the form of a potassium salt.

The detergent composition may also include an effective process facilitating proportion of water, an amount of a hydrating agent effective for complexing a sufficient proportion of the water so as to contribute to solidification of the composition, a detersive amount of a nonionic surfactant, and/or a secondary chelating agent.

The detergent composition is conveniently formulated by sequentially (i) combining an aminocarboxylic acid sequestrant with a sufficient proportion of a potassium alkaline source so as to neutralize at least a portion of the aminocarboxylic acid sequestrant to the potassium salt, (ii) adding a sufficient proportion of a sodium alkaline source so as to neutralize any remaining unreacted aminocarboxylic acid sequestrant to the sodium salt and provide a source of alkalinity to the composition, (iii) adding other desired components such as additional water, a casting agent, a nonionic surfactant, and/or a secondary chelating agent, and then (iv) casting the composition.

A detergent composition formulated in accordance with the invention solidifies at a rate which permits routine blending and casting of the composition after combination of all of the components.

DETAILED DESCRIPTION OF THE INVENTION INCLUDING A BEST MODE

As utilized herein, including the claims, the term "wt %" refers to the weight proportion based upon the total weight of the composition

Composition

The detergent composition is a solid cast block which includes a sodium based alkaline source as a detersive component and the potassium salt of an aminocarboxylic acid as a sequestrant. The resultant detergent composition may also include: (i) a potassium based alkaline source as a detersive component, (ii) the sodium salt of an aminocarboxylic acid as a sequestrant, (iii) water for facilitating processing and permitting solidification, (iv) a hydrating agent for facilitating solidification, (v) a secondary sequestrant, and/or (iv) other typical detergent additives such as dyes, perfumes, bleaching agents, threshold agents, fillers and the like.

When the composition includes both sodium and potassium salts of an aminocarboxylic acid and/or both sodium and potassium alkaline sources, the ratio between the sodium and potassium compounds must be maintained so as to provide for both sufficient processing time before solidification and an adequately hardened final product. In general, an excess of sodium based compounds (particularly an excess of the sodium salt of the aminocarboxylic acid) results in solidification occurring too rapidly while an excess of potassium based compounds (particularly an excess of the potassium salt of the aminocarboxylic acid) results in a soft final product.

Alkaline Sources

A first active component in the solid cast detergent composition is a sodium based alkaline source. As utilized herein, the term "alkaline source" refers to those caustic compounds which are useful for providing detersive action and improving soil removal performance. Typical sodium based sources of alkalinity include sodium hydroxide and sodium silicate.

The detergent composition may also include the potassium form of an alkaline source such as potassium hydroxide, potassium silicate and potassium oxide. However, the mole ratio of sodium to potassium hydroxides in the detergent composition should be maintained at about 1:0.1 to about 1:6 (preferably about 1:0.5 to 1:4) as an excessive proportion of the potassium form can completely inhibit solidification of the composition.

The alkaline source should comprise about 10 to 40 wt %, preferably about 15 to 30 wt %, of the detergent composition in order to provide effective cleansing. A deficiency in the amount of alkali metal hydroxide can adversely affect the soil removal performance of the composition while an excess results in a significant increase in the cost of the cast detergent composition without providing commensurate benefits.

Chelating Agent

A second active component in the solid cast detergent composition is the potassium salt of an aminocarboxylic acid sequestering agent. Generally, sequestering agents are those molecules capable of coordinating the metal ions commonly found in service water and thereby preventing the metal ions from interfering with the functioning of the detersive component(s) of the composition. The number of covalent bonds capable of being formed by a sequestrant upon a single hardness ion is reflected by labeling the sequestrant as bidentate (2), tridentate (3), tetradentate (4), etc. Suitable aminocarboxylic acid chelating agents include N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA). EDTA is a hexadentate.

The detergent composition may also include a proportion of the sodium salt of an aminocarboxylic acid sequestering agent. However, the mole ratio of sodium to potassium salts of the aminocarboxylic acids should be maintained between about 1:0.1 to 1:12 (preferably between about 1:0.5 to 1:10 and most preferably between about 1:0.5 to 1:4) as an excessive proportion of the sodium salt can result in solidification occurring too rapidly to permit appropriate processing of the composition.

The alkali metal salts of the aminocarboxylate sequestering agent should comprise about 20 to 40 wt %, preferably about 25–35 wt %, of the detergent composition in order to provide practical and cost effective sequestration.

Water

Water is employed in the detergent composition to facilitate processing and facilitate solidification. A combination of the alkaline source and the aminocarboxylic acid in an aqueous medium produces a medium which is processable as a molten melt at elevated temperatures forms a hard solid at room temperatures. The water may be added separately or as a customary constituent in one of the other components (Example: alkali metal hydroxides are commonly available as aqueous solutions). For purposes of simplicity, at least a portion of the water employed in the composition is preferably provided with the potassium alkaline source which is to be reacted with the aminocarboxylic acid to produce the potassium salt of the aminocarboxylic acid.

Solidifying Agent

Solidification of the detergent composition may be facilitated by incorporating an effective amount of a hydrating agent to the composition which is capable of accepting excess water from the composition as water of hydration. For reasons of processing convenience, the hydrating agent should be capable of forming a molten hydrate at a processing temperature of about 20°–80° C., preferably about 30°–50° C. Suitable solidifying agents include specifically, but not exclusively, alkali metal hydroxides, alkali metal phosphates, anhydrous sodium carbonate, anhydrous sodium sulfate, anhydrous sodium acetate, and other known hydratable compounds.

Anhydrous sodium carbonate and anhydrous sodium sulfate are the solidifying agents of choice as they form a hydrate having a melting point of 32° C. and 34° C. respectively, which is below the decomposition temperature of common sources of active halogen, and are capable of providing a solid detergent composition at temperatures of about 15°–25° C. In addition, the heat generated by hydration of the carbonate/sulfate can be employed to heat the composition to a molten state thereby eliminating the need to provide an external heating source. However, because of the highly exothermic nature of the reaction, controls should be provided in order to maintain the composition at a temperature only slightly above the melting point, about 35°–50° C., until all the components have been added and thoroughly blended.

The amount of solidifying agent necessary to achieve solidification depends upon several factors including the exact solidifying agent employed, the amount of water in the composition, and the hydration capacity of the other detergent components. Typically, the inclusion of about 18 to 35 wt % solidifying agent is effective for obtaining solidification.

Surfactant(s)

A surfactant may be included in the detergent composition to enhance the cleaning efficiency of the composition. Selection of an appropriate surfactant requires consideration of performance, compatibility with the other components (including the alkaline source), effect upon solidification of the composition, and foaming characteristics. The favored surfactants are the nonionic surfactants as they are generally effective for enhancing the detergency of the composition, stable under highly alkaline conditions, and low foaming. A detailed discussion of nonionic surfactants may be found in *Kirk-Othmer Encyclopedia of Chemical Technology,* Second Edition, volume 19, pages 531–554. A discussion of defoaming nonionic surfactants may be found in U.S. Pat. Nos. 3,048,548 (Martin et al), 3,334,147 (Brunelle et al), and 3,442,242 (Rue et al).

Secondary Sequestering Agent

A secondary sequestering agent may optionally be included in the detergent composition to further increase the sequestering capacity of the composition.

Selection of a suitable secondary sequestrant requires consideration of performance, compatibility with the other components (including the alkaline source), and effect upon solidification of the composition. A detailed discussion of sequestrants may be found in *Kirk-Othmer Encyclopedia of Chemical Technology,* Second Edition, volume 6, pages 1–24. Suitable secondary sequestrants for use in the composition include the aminocarboxylic acids, hydroxy acids, and/or alkali metal phosphates. Because they are readily available at low cost and cooperate well with the aminocarboxylic acid sequestrant(s) already in the composition, the secondary sequestrants of choice are the alkali metal phosphates. Specifically, the preferred alkali metal phosphates are those with the formula $M—(PO_3M)_n$ wherein M is a alkali metal and n is a whole number ranging from 1 to about 60. A nonexhaustive list of exemplary condensed phosphates suitable for use in the composition include sodium and potassium orthophosphates, such as monosodium orthophosphate, disodium orthophosphate, and trisodium orthophosphate, and sodium and potassium condensed phosphates such as tetrasodium pyrophosphate, sodium trimetaphosphate, and sodium tripolyphosphate. A detailed discussion of phosphates may be found in *Kirk-Othmer Encyclopedia of Chemical Technology,* Second Edition, volume 15, pages 232–276.

The amount of any water added to the composition along with the phosphate in either free or hydrated form must be factored into the wt % of water included into the composition.

If desired, components which are incompatible with the highly alkaline detergent composition such as a chlorine source or a defoamant may be included in the cast composition in the form of preformed plugs which can be inserted into the mixture just prior to solidification.

Broadly, the detergent composition should comprise about 70–85 wt %, preferably about 75–85 wt %, solids and about 15–25 wt %, preferably about 15–20 wt %, water including both free water and water of hydration.

Formulation

The detergent composition should generally be prepared by (i) combining the aminocarboxylic acid chelating agent and at least a portion of the potassium alkaline source under conditions of constant agitation and increased temperatures to form a first mixture wherein the potassium alkaline source exothermically reacts with the aminocarboxylic acid chelating agent to neutralize the chelating agent and form a potassium salt of the chelating agent, (ii) adding the sodium alkaline source and any remaining potassium alkaline source to the first mixture, after completion of the neutralization reaction between the aminocarboxylic acid chelating agent and the potassium alkaline source, also under conditions of constant agitation and increased temperature, to complete neutralization of the chelating agent and form a second mixture, (iii) adding any optional components to the second mixture such as a secondary sequestering agent, a surfactant, and/or a solidifying agent after completion of the neutralization reaction, also under conditions of constant agitation and increased temperature, to form a third mixture, (iv) casting the third mixture into a mold, (v) inserting any preformed plugs into the cast composition prior to solidification, and (v) cooling and solidifying the cast composition.

It is noted that solidification of the composition may involve one or more physical/chemical mechanisms including specifically, but not exclusively, freezing, precipitation, hydration, crystallization, and the like.

Processing of the preferred composition preferably includes the steps of: (i) adding potassium hydroxide as the potassium alkaline source to ethylenediaminetetraacetic acid as the aminocarboxylic acid chelating agent to partially neutralize the aminocarboxylic acid and form a first mixture, (ii) adding an excess of sodium hydroxide to complete neutralization of the aminocarboxylic acid chelating agent and provide a quantity of unreacted sodium hydroxide, (iii) adding any additional components, and then (iv) casting, cooling and solidifying.

In the preferred embodiment, a sufficient amount of potassium hydroxide is added to the aminocarboxylic acid sequestering agent to neutralize approximately 50 to 100% of the aminocarboxylic acid and then sufficient sodium hydroxide is added to complete neutralization of the aminocarboxylic acid and provide about 5 to 40 wt %, preferably about 5 to 20 wt %, unreacted sodium hydroxide in the detergent composition.

The detergent composition may be cast into a temporary mold from which it is subsequently transferred for packaging in a separate receptacle, or may be cast directly into the receptacle used for shipping and sale. Preferably, the composition is cast directly into the final container in order to eliminate the transfer step.

Solidification Rate

The solidification rate of the detergent composition should be slow enough to prevent solidification within the processing and packaging equipment yet short enough to avoid unnecessary delays in production. Generally, a solidification rate which results in a solid product in about 2 to 6 hours is sufficient to achieve both desired results.

Detergent compositions containing an aminopolycarboxylic acid(s) which include only NaOH as the alkaline source tend to solidify within minutes after addition of the NaOH while those which include only KOH tend to solidify only after extended periods (10 hours or more) and often never fully solidify.

Referring to Experimental Runs 13, 15b and 20 and FIG. 1, the solidification rate can be significantly affected by (i) the ratio of sodium to potassium hydroxides in the composition, and (ii) the ratio of sodium to potassium salts of the aminocarboxylic acid. The solidification rate tends to decrease with an increase in the proportion of potassium hydroxide relative to sodium hydroxide and decrease with an increase in the proportion of potassium salts of the aminocarboxylic acid relative to the sodium salts of the aminocarboxylic acid.

Dispensing

The detergent composition may be conveniently dispensed from a spray-type dispenser such as those disclosed in U.S. Pat. Nos. 4,426,326, 4,569,780, 4,569,781 and 4,687,121. Briefly, spray-type dispensers generally function by supporting a downwardly open receptacle containing a solid block of detergent above a spray nozzle and directing a water spray from the spray nozzle into the receptacle so as to dissolve a portion of the solid block of material and form a concentrated solution. The concentrated solution is then immediately directed to the point of use.

The present invention may be further understood by reference to the following specific examples which are illustrative of the composition, form and method of forming the solid cast detergent composition of this invention.

Experimental Procedure

The components listed in Table 1 were mixed in a mixing vessel equipped with a variable speed agitator and a cooling jacket in the sequence listed in Table 2. The maximum temperature attained by the mixture as the various components were added to the composition are set forth in Table 3 wherein the symbol (*) indicates that cooling was required to maintain the indicated temperature during and/or immediately after addition of the specified component. Comments and/or observations as to the mixing process, characteristics of the mixture and characteristics of the final product are provided in Table 4.

TABLE 1

[grams (wt %)]

| Exp # | EDTA.$H_4$ | EDTA.$Na_4$ | KOH.sol | KOH.flk | NaOH.sol | NaOH.bead | STPP | $Na_2SO_4$ |
|---|---|---|---|---|---|---|---|---|
| 1 | 110 (55%) | 20 (10%) | | | | 26 (13%) | 8 (4%) | 34 (17%) |
| 2 | 110 (55%) | 20 (10%) | | | | 26 (13%) | 24 (12%) | 18 (9%) |
| 3 | 35 (35%) | | 15 (15%) | | 25 (25%) | | 25 (25%) | |
| 4 | 50 (20.8%) | | 120 (50%) | | | 30[1] (12.5%) | 30 (12.5%) | |
| 5 | 92 (23%) | | 84 (21%) | 80 (20%) | | | 16 (4%) | 124 (31%) |
| 6 | 230 (23%) | | 220 (22%) | 110 (11%) | | 90 (9%) | 40 (4%) | 300 (30%) |
| 7 | 69 (23%) | | 66 (22%) | 16.5 (5.5%) | | 36 (12%) | 12 (4%) | 97.5 (32.5%) |
| 8 | 69 (23%) | | 66 (22%) | 25.5 (8.5%) | | 31.5 (10.5%) | 12 (4%) | 93 (31%) |
| 9 | 69 (23%) | | 66 (22%) | 33 (11%) | | 27 (9%) | 12 (4%) | 84 (28%) |
| 10 | 69 (23%) | | 66 (22%) | 30 (10%) | | 30 (10%) | 12 (4%) | 84 (28%) |
| 11 | 69 (23%) | | 57 (19%) | 39 (13%) | | 27 (9%) | 12 (4%) | 81 (27%) |
| 12 | 230 (23%) | | 200 (20%) | 130 (13%) | | 90 (9%) | 40 (4%) | 280 (28%) |
| 13 | 230 (23%) | | 200 (20%) | 130 (13%) | | 68 (6.8%) | 40 (4%) | 282 (28.2%) |
| 14 | 11.5 (23%) | | 10 (20%) | 7.5 (15%) | | 2.25 (4.5%) | 2 (4%) | 14.25 (28.5%) |
| 15a | 230 (23%) | | 200 (20%) | 150 (15%) | | 45 (4.5%) | 40 (4%) | 285 (28.5%) |
| 15b | 230 (23%) | | 200 (20%) | 150 (15%) | | 45 (4.5%) | 40 (4%) | 285 (28.5%) |
| 16 | 25 (25%) | | 25 (25%) | | | 8 (8%) | 5 (5%) | 36 (36%) |
| 17 | 25 (25%) | | 22 (22%) | | | 11 (11%) | 4 (4%) | 37 (37%) |
| 18 | 25 (25%) | | 35 (35%) | 4 (4%) | | 8 (8%) | 4 (4%) | 23 (23%) |
| 19 | 25 (25%) | | 19 (19%) | | | 14 (14%) | 4 (4%) | 37 (37%) |
| 20 | 115 (23%) | | 100 (20%) | 65 (13%) | | 34 (6.8%) | 20 (4%) | 141 (28.2%) |

| Exp # | PAA[1] | PAA[2] | Gdrght | BtEA | $CH_3COONa$ |
|---|---|---|---|---|---|
| 1 | | | | 2 (1%) | |
| 2 | | | | 2 (1%) | |
| 3 | | | | | |
| 4 | | | | | 10 (4.2%) |
| 5 | | | | 4 (1%) | |
| 6 | | | | 10 (1%) | |
| 7 | | | | 3 (1%) | |
| 8 | | | | 3 (1%) | |
| 9 | | | 6 (2%) | 3 (1%) | |
| 10 | | | 6 (2%) | 3 (1%) | |
| 11 | | 12 (4%) | | 3 (1%) | |
| 12 | | 20 | | 10 | |

TABLE 1-continued

[grams (wt %)]

| | | | |
|---|---|---|---|
| | | (2%) | (1%) |
| 13 | 40 | | 10 |
| | (4%) | | (1%) |
| 14 | 2 | | 0.5 |
| | (4%) | | (1%) |
| 15a | 40 | | 10 |
| | (4%) | | (1%) |
| 15b | 40 | | 10 |
| | (4%) | | (1%) |
| 16 | | | 1 |
| | | | (1%) |
| 17 | | | 1 |
| | | | (1%) |
| 18 | | | 1 |
| | | | (1%) |
| 19 | | | 1 |
| | | | (1%) |
| 20 | 20 | | 5 |
| | (4%) | | (1%) |

TABLE 2

(Sequence of Addition)

| Exp # | EDTA.$H_4$ | EDTA.$Na_4$ | KOH.sol | KOH.flk | NaOH.sol | NaOH.bead | STPP | $Na_2SO_4$ |
|---|---|---|---|---|---|---|---|---|
| 1 | 1 | 3 | | | | 2 | 6 | 4 |
| 2 | 1 | 2 | | | | 4 | 5 | 3 |
| 3 | 2 | | 1 | | 3 | | 4 | |
| 4 | 2 | | 1 | | | 3(10 g)<br>6(20 g) | 4 | |
| 5 | 2 | | 1 | 3 | | | 6 | 5 |
| 6 | 2 | | 1 | 4 | | 3 | 7 | 6 |
| 7 | 2 | | 1 | 3 | | 4 | 7 | 6 |
| 8 | 2 | | 1 | 3 | | 4 | 7 | 6 |
| 9 | 2 | | 1 | 4 | | 5 | 8 | 7 |
| 10 | 2 | | 1 | 4 | | 5 | 8 | 7 |
| 11 | 3 | | 1 | 4 | | 5 | 8 | 7 |
| 12 | 3 | | 1 | 4 | | 8 | 7 | 6 |
| 13 | 3 | | 1 | 4 | | 8 | 7 | 6 |
| 14 | 3 | | 1 | 4 | | 8 | 7 | 6 |
| 15a | 3 | | 1 | 4 | | 8 | 7 | 6 |
| 15b | 3 | | 1 | 4 | | 8 | 7 | 6 |
| 16 | 2 | | 1 | | | 3 | 6 | 4 |
| 17 | 2 | | 1 | | | 3 | 6 | 4 |
| 18 | 3 | | 1 | 2 | | 4 | 7 | 5 |
| 19 | 2 | | 1 | | | 3 | 6 | 4 |
| 20 | 3 | | 1 | 4 | | 8 | 7 | 6 |

| Exp # | PAA[1] | PAA[2] | Gdrght | BtEA | $CH_3COONa$ |
|---|---|---|---|---|---|
| 1 | | | | 5 | |
| 2 | | | | 6 | |
| 3 | | | | | |
| 4 | | | | | 5 |
| 5 | | | | 4 | |
| 6 | | | | 5 | |
| 7 | | | | 5 | |
| 8 | | | | 5 | |
| 9 | | | 3 | 6 | |
| 10 | | | 3 | 6 | |
| 11 | | 2 | | 6 | |
| 12 | | 2 | | 5 | |
| 13 | 2 | | | 5 | |
| 14 | 2 | | | 5 | |
| 15a | 2 | | | 5 | |
| 15b | 2 | | | 5 | |
| 16 | | | | 5 | |
| 17 | | | | 5 | |
| 18 | | | | 6 | |
| 19 | | | | 5 | |
| 20 | 2 | | | 5 | |

TABLE 3

[maximum temperature (°F.)]

| Exp # | EDTA.$H_4$ | EDTA.$Na_4$ | KOH.sol | KOH.flk | NaOH.sol | NaOH.bead | STPP | $Na_2SO_4$ |
|---|---|---|---|---|---|---|---|---|
| 1 | — | — | | | | 141° | 113° | 117° |
| 2 | 77° | 79° | | | | 143° | 122° | 79° |
| 3 | — | | — | | — | | — | |

TABLE 3-continued

[maximum temperature (°F.)]

| | | | | | | | |
|---|---|---|---|---|---|---|---|
| 4 | — | — | | | — | — | |
| 5 | — | — | 171° | | | 96° | 96–98° |
| 6 | *164° | — | — | | — | — | — |
| 7 | — | — | — | | — | — | — |
| 8 | — | — | — | | — | — | — |
| 9 | — | — | — | | — | — | — |
| 10 | — | — | — | | — | — | — |
| 11 | — | — | 175° | | 125–130° | 119° | 118–124° |
| 12 | — | — | — | | — | 108° | — |
| 13 | *170° | 81° | *185° | | 107° | 106° | 109–116° |
| 14 | *170° | 88° | 180° | | 95° | 95° | 112° |
| 15a | *151° | 83° | 168° | | 115° | 102° | 105° |
| 15b | 171° | 81° | 214° | | 104° | 108° | 115° |
| 16 | — | — | | | — | — | — |
| 17 | — | — | | | — | 130° | 130° |
| 18 | — | — | — | | — | — | — |
| 19 | — | — | | | — | — | — |
| 20 | *155° | — | *184° | | 108° | 108° | 114° |

| Exp # | PAA[1] | PAA[2] | Gdrght | BtEA | $CH_3COONa$ |
|---|---|---|---|---|---|
| 1 | | | | — | |
| 2 | | | | 119° | |
| 3 | | | | | |
| 4 | | | | | — |
| 5 | | | | — | |
| 6 | | | | — | |
| 7 | | | | — | |
| 8 | | | | — | |
| 9 | | | — | — | |
| 10 | | | — | — | |
| 11 | | — | | — | |
| 12 | | — | | — | |
| 13 | 127° | | | — | |
| 14 | 118° | | | *140° | |
| 15a | 131° | | | *144° | |
| 15b | 126° | | | 157° | |
| 16 | | | | — | |
| 17 | | | | 130° | |
| 18 | | | | — | |
| 19 | | | | — | |
| 20 | 118° | | | *140° | |

TABLE 4

(Comments/Observations)

| Exp # | Comments Mixing Procedure | Characteristics Product |
|---|---|---|
| 1 | Mixture of EDTA and NaOH exothermed to 141° F., solidified, and then remelted to a fluid mixture. | Never resolidified. |
| 2 | Mixture solidified before all NaOH could be added. Hand mixing caused mixture to liquify so that remaining components could be added. | Never resolidified. |
| 3 | Mixture became extremely hot and solidified quickly while adding the NaOH. Unable to add STTP. | Solid. |
| 4 | NaOH added to the mixture after combining KOH solution and EDTA (10 grams) and after addition of $CH_3COONa$ (20 grams) as mixture still very flowable after addition of $CH_3COONa$. | Never solidified |
| 5 | Viscosity acceptable to mixing at all stages. | Viscosity of final product measured at 4600 cps with a Brookfield Viscometer using a #5 spindle rotated at 10 rpm at a product temperature of 97° F. Can push spatula about 1" into final hardened product. |
| 6 | Mixture solidified with 10 grams of KOH remaining to be added. | Solidified before addition of components completed. |
| 7 | Mixture solidified shortly after NaOH added. Unable to incorporate remaining components. | Solidified before addition of components completed. |
| 8 | Viscosity acceptable to mixing at all stages but solidified about 5 minutes after addition of all | Solid. |

TABLE 4-continued (Comments/Observations)

| Exp # | Comments Mixing Procedure | Characteristics Product |
|---|---|---|
| | components. | |
| 9 | Viscosity acceptable to mixing at all stages. | Solid next day. |
| 10 | Viscosity acceptable to mixing at all stages. Mixed for about 15 to 20 minutes after addition of all components. | Solid within minutes after completion of agitation. |
| 11 | | Viscosity of final product measured at 3300 cps with a Brookfield Viscometer using a #5 spindle rotated at 10 rpm at a product temperature of 99° F. |
| 12 | | Viscosity of the final product was repeatedly measured with a Brookfield Viscometer using a #5 spindle rotated at 10 rpm after addition of the NaOH bead. The recorded data is set forth below. |

| Time After Addition of NaOH (min) | Temperature (°F.) | Viscosity (cps) |
|---|---|---|
| 20 | 99° | 1,500 |
| 60 | 110° | 3,000 |

Final product solidified about 90 minutes after addition of the NaOH bead.

Viscosity of the final product was repeatedly measured with a Brookfield Viscometer using a #5 spindle rotated at 10 rpm after addition of the NaOH bead. The recorded data is set forth below.

| Time After Addition of NaOH (min) | Temperature (°F.) | Viscosity (poise) |
|---|---|---|
| 10 | 101° | 17.6 |
| 40 | 100° | 20–22 |
| 70 | 100½° | 28–29 |
| 100 | 101° | 80–90 |
| 115 | 101° | 150–160 |
| 130 | 101° | 280–300 |

Final product solidified about 150 minutes after addition of the NaOH bead.

| | | |
|---|---|---|
| 14 | Viscosity acceptable to mixing at all stages. Final product cast into 5 separate capsules. | Viscosity of the final product was repeatedly measured with a Brookfield Viscometer using a #4 spindle rotated at 20 rpm after addition of the NaOH bead. The recorded data is set forth below. |

| Time After Addition of NaOH (min) | Temperature (°F.) | Viscosity (cps) |
|---|---|---|
| 15 | 95° | 1,360 |
| 45 | 100° | 1,550 |
| 75 | 100½° | 1,650 |

Final product still very fluid 90 minutes after addition of the NaOH bead. Solid after sitting over night.

| | | |
|---|---|---|
| 15a | Viscosity acceptable to mixing at all stages.<br><br>Mixture warmed to 103° F. prior to addition of NaOH bead. | Viscosity of the final product was repeatedly measured with a Brookfield Viscometer using a #5 spindle after addition of the NaOH bead. The first reading was conducted at an rpm of 10. The second and third readings were conducted at an rpm of 2.5. The fourth reading, after addition of 1% hexylene glycol to the product, was conducted at 1 rpm. |

| Time After Addition of NaOH (min | Temperature (°F.) | Viscosity (cps) |
|---|---|---|

TABLE 4-continued

| Exp # | Comments Mixing Procedure | (Comments/Observations) Characteristics Product |
|---|---|---|
| | | 15 106° 1,200<br>75 103½° 2,700<br>135 115° 99,000<br>145 115° 370,000 |
| 15b | Viscosity acceptable to mixing at all stages. | Viscosity of the final product was repeatedly measured with a Brookfield Viscometer using a #5 spindle rotated at 10 rpm after addition of the NaOH bead. The recorded data is set forth below.<br>Time After Addition of NaOH (min) / Temperature (°F.) / Viscosity (poise)<br>15 101° 9.2<br>45 102° 9.2<br>75 99° 10.4<br>105 98° 14.0<br>135 98° 21.6–24.0<br>165 99° 46.0–53.0<br>195 101° 92.0–98.0<br>225 103° 270–280<br>Final product placed in a cool water bath between 225 and 285 minutes after addition of the NaOH bead. Final product solid about 6 hours after addition of the NaOH bead. |
| 16 | Low viscosity during processing. | Final product never solidified except at the bottom where the solids had settled. |
| 17 | Fairly viscous during processing but acceptable to mixing at all stages. $Na_2SO_4$, BtEA and STPP added with mixture at 130° F. Final product poured at 125° F. | Final product solidified within 4 hours after addition of $Na_2SO_4$, BtEA and STPP. |
| 18 | Fairly viscous during processing but acceptable to mixing at all stages. Viscosity increased fairly substantially while adding $Na_2SO_4$. Final product poured at 120° F. | Viscosity sufficient for preventing settling and stratification immediately after casting. |
| 19 | Fairly viscous during processing but acceptable to mixing at all stages. Viscosity of final mixture so high that the mixture had to be "spooned" out of the mixing vessel at 120°F. | |
| 20 | Viscosity acceptable to mixing at all stages. | Viscosity of the final product was repeatedly measured with a Brookfield Viscometer using a #5 spindle rotated at 10 rpm after addition of the NaOH bead. The recorded data is set forth below.<br>Time After Addition of NaOH (min) / Temperature (°F.) / Viscosity (poise)<br>0 100° 16.4<br>40 98° 22.0<br>60 101° 30.0<br>120 105° 340.0<br>140 106° too high to measure<br>Final product completely solid about 6 hours after addition of the NaOH bead. |

Conclusions

Compositions based solely upon sodium hydroxide solidified substantially immediately after the sodium hydroxide is added to the EDTA with subsequent reliquification and failure to resolidify (Exp #1,#2). Compositions based solely upon potassium hydroxide never solidified (Exp #5). Compositions employing appropriate ratios of both sodium and potassium hydroxides with at least a portion of the potassium hydroxide added to the EDTA prior to addition of any sodium hydroxide produced a solid product while providing a delay in solidification. The ratio of sodium to potassium hydroxides in the composition may be adjusted to achieve any desired delay in solidification for the purpose of permitting appropriate processing without excessively delaying the manufacturing process.

Nomenclature

EDTA.$H_4$: Ethylenediaminetetraacetic acid

EDTA.$Na_4$: Sodium salt of Ethylenediaminetetraacetic acid

KOH.sol: Aqueous solution of potassium hydroxide containing 45% potassium hydroxide.

KOH-flk: Solid flakes of potassium hydroxide.

NaOH.sol: Aqueous solution of sodium hydroxide containing 50% sodium hydroxide.

NaOH.bead: Solid beads of sodium hydroxide.

STPP: Granular sodium tripolyphosphate.

$Na_2SO_4$: Granular sodium sulfate.

PAA[1]: A polyacrylate having an average molecular weight of about 4,500.

PAA[2]: A copolymer of acrylic acid and itaconic acid having an average molecular weight of about 8,000–10,000.

Gdrght: (Goodright 7058D TM) A powdered salt of a granular polyacrylate having an average molecular weight of about 6,000 available from B. F. Goodrich.

BtEA: A Benzyl terminated ethoxylated alcohol surfactant described in detail in U.S. Pat. No. 3,444,242.

$CH_3COONa$: Granular sodium acetate.

The description is provided to aid in a complete non-limiting understanding of the invention. Since many variations of the invention may be made without departing from the spirit and scope of the invention, the breadth of the invention resides in the claims hereinafter appended.

I claim:

1. A solid cast detergent composition, comprising a substantially homogenous solid cast product which includes at least:

(a) an effective hard surface cleansing proportion of a sodium alkaline source and a potassium alkaline source said source being present in a mole ratio of sodium alkaline source to potassium alkaline source of 1:0.1 to about 1:6, wherein the sodium alkaline source is selected from the group consisting of sodium hydroxide, sodium silicate, and mixtures thereof, and the potassium alkaline source is selected from the group consisting of potassium oxide, potassium hydroxide, potassium silicate, and mixtures thereof and (b) an effective chelating proportion of a mixture of sodium salt of aminocarboxylic acid sequestrant and a potassium salt of aminocarboxylic acid sequestrant in a mole ratio of sodium salt of aminocarboxylic acid sequestrant to potassium salt of aminocarboxylic acid sequestrant of about 1:0.1 to 1:12, wherein the ratio of sodium salt of aminocarboxylic acid sequestrant to potassium salt of aminocarboxylic acid sequestrant and the ratio of sodium alkaline source to potassium alkaline source are effective to delay solidification and to maintain the viscosity of the composition below 4,000 cps for at least 2 hours under constant agitation at a temperature of 40° C. while resulting in the solid cast final product.

2. An article of commerce, comprising: a receptacle into which has been cast a substantially homogenous solid product which includes at least (i) an effective hard surface cleansing proportion of a sodium alkaline source and a potassium alkaline source said source being present in a mole ratio of sodium alkaline source to potassium alkaline source of 1:0.1 to about 1:6, wherein the sodium alkaline source is selected from the group consisting of sodium hydroxide, sodium silicate, and mixtures thereof, and the potassium alkaline source is selected from the group consisting of potassium oxide, potassium hydroxide, potassium silicate, and mixtures thereof, and (ii) an effective chelating proportion of a mixture of a sodium salt of aminocarboxylic acid sequestrant and a potassium salt of aminocarboxylic acid sequestrant in a mole ratio of sodium salt of aminocarboxylic acid sequestrant to potassium salt of aminocarboxylic acid sequestrant of about 1:0.1 to 1:12, wherein the ratio of sodium salt of aminocarboxylic acid sequestrant to potassium salt of aminocarboxylic acid sequestrant and the ratio of sodium alkaline source to potassium alkaline source are effective for maintaining the viscosity of the composition below 4,000 cps for at least 2 hours under the constant agitation at a temperature of 40° C. while resulting in the solid cast final product.

3. The detergent composition of claim 1 wherein the aminocarboxylic acid sequestrant is selected from the group consisting of nitrilodiacetic acid, nitrilotriacetic acid, ethylenediamine triacetic acid, ethylenediamine tetraacetic acid, and mixtures thereof.

4. The detergent composition of claim 1 wherein the mole ratio of sodium aminocarboxylic acid sequestrant to potassium aminocarboxylic acid sequestrant is about 1:0.5 to 1:10.

5. A solid cast warewashing detergent composition, that comprises:

(a) about 2 to about 15 wt % of a source of alkalinity that includes a sodium alkaline source and a potassium alkaline source, wherein the mole ratio of sodium alkaline source to potassium alkaline source is about 1:0.1 to 1:6 wherein the sodium alkaline source is selected from the group consisting of sodium hydroxide, sodium silicate, and mixtures thereof, and the potassium alkaline source is selected from the group consisting of potassium oxide, potassium hydroxide, potassium silicate, and mixtures thereof;

(b) about 20 to about 40 wt % of a mixture of sodium and potassium salts of an aminocarboxylic acid sequestrant wherein the mole ratio of sodium salt of aminocarboxylic acid sequestrant to potassium salt of aminocarboxylic acid sequestrant is about 1:0.5 to 1:10;

(c) about 15 to 45 wt % of a solidifying agent selected from the group consisting of sodium sulfate, sodium carbonate, and mixtures thereof; and (d) about 9 to about 30 wt % of hydration.

6. The cast detergent composition of claim 5 wherein the aminocarboxylic acid sequestrant is ethylenediamine tetraacetic acid.

* * * * *